US006453047B1

(12) United States Patent
Dicker et al.

(10) Patent No.: US 6,453,047 B1
(45) Date of Patent: Sep. 17, 2002

(54) MATRIX ENCODING SYSTEM WITH IMPROVED BEHAVIOR FREQUENCY

(75) Inventors: Sam Dicker, Santa Cruz, CA (US); Huisheng Wang, Singapore (SG); Jean-Marc Jot, Aptos, CA (US)

(73) Assignee: Creative Technology LTD (SG)

( * ) Notice: Subject to any disclaimer, the term of this patent is extended or adjusted under 35 U.S.C. 154(b) by 0 days.

(21) Appl. No.: 09/407,682

(22) Filed: Sep. 28, 1999

Related U.S. Application Data

(60) Provisional application No. 60/102,192, filed on Sep. 28, 1998.

(51) Int. Cl.[7] ..... H04R 5/00
(52) U.S. Cl. ..... 381/23
(58) Field of Search ..... 381/21, 23, 20, 381/22, 19, 18

(56) References Cited

U.S. PATENT DOCUMENTS 3,770,901 A * 11/1973 Bauer
5,796,844 A * 8/1998 Griesinger
6,198,827 B1 * 3/2001 Waller, Jr.

OTHER PUBLICATIONS

"Dolby Pro Logic Surround Decoder Principles of Operation," Roger Dressler (http://www.dolby.com/tech/whtp-pr.html) [online] [retrieved on Jun. 15, 2000].
encoder schematic, Fig. 1 (http://www.dolby.com/tech/fig01–60.jpg) [online] [retrieved on Jun. 15, 2000].

* cited by examiner

*Primary Examiner*—Forester W. Isen
*Assistant Examiner*—Brian Tyrone Pendleton
(74) *Attorney, Agent, or Firm*—Townsend and Townsend and Crew LLP

(57) ABSTRACT

A conveyor mat built up from hingedly intercoupled plastic modules, each module consisting of a number of substantially equally spaced apart hinge plates extending throughout the length of the module and provided with hinge loops at both ends thereof, the outer hinge plate and a plate-shaped part located on the outer side of a module of at least a number of modules extending to a position below the bottom face of the mat formed by the successive modules or being provided with a recess in the longitudinal direction of the module, the arrangement being such that the thus formed downward extension and/or the recesses form a lateral guide for the conveyor mat and can cooperate with a tubular or U-shaped guide section respectively.

8 Claims, 2 Drawing Sheets

MATRIX ENCODING SYSTEM WITH IMPROVED BEHAVIOR FREQUENCY

CROSS-REFERENCE TO RELATED APPLICATIONS

This application claims priority from provisional application Ser. No. 60/102,192, filed Sep. 28, 1998, entitled "Three Channel Panning System", the disclosure of which is incorporated herein by reference.

The invention relates to a conveyor mat built up from modules manufactured in one whole from plastic, each module consisting of a number of substantially equally spaced apart hinge plates and an end hinge plate, each extending over substantially the entire length of the module and each having both ends provided with hinge loops, the hinge plates of a module being intercoupled by at least one transverse rib and there being provided, adjacent at least the outer hinge plate at the transverse end of the module located opposite the end hinge plate, a plate-shaped part extending parallel to said hinge plate over a distance smaller than the distance between the hinge loops in a hinge plate and coupled to the at least one rib of the module and whose top side lies substantially in one plane with the top side of the mat, the end hinge plates of the successive modules being alternately located on one and on the other lateral side of the conveyor mat, the ends of the hinge plates on a longitudinal side of a module being located between the ends of the hinge plates of a module adjoining in longitudinal direction of the mat, the hinge loops of the two modules being substantially in alignment and intercoupled by a hinge pin extending through the hinge loops.

Such modular conveyor mat is known from EP-A-0 598 453. This patent application describes a conveyor mat consisting of first and second modules assembled in a brickstone connection, the second modules forming so-called end modules, present exclusively at the outer edge of the mat, viz alternately with a module of the first type, viewed in the conveying direction of the mat. This patent application also describes the possibility of manufacturing a narrow conveyor mat, consisting exclusively of second or end modules, said modules being alternately arranged, such that at each lateral edge of the mat a wide end hinge plate and a relatively narrow plate portion are alternately present.

In so-called "shrink-wrap" machines, narrow conveyor mats are used, because in such machines it is desired that bottles, cans and the like to be packed can be conveyed in a single line. Up to the present, such conveyor mats have been manufactured by shortening a wide mat in transverse direction by a sawing operation. This entails the drawback of creating additional labor costs and of the mat having an irregular lateral edge. A further problem is that the known mats are guided in a slot-shaped section. Consequently, it is not possible to form, if so desired, a wider conveying surface consisting of several tracks in close side-by-side relationship, because the lateral edges of adjacent mats cannot lie in close side-by-side relationship.

The object of the invention is to provide a conveyor mat for such practical applications which does not have the above drawbacks. To that end, according to a first aspect, the invention provides a conveyor mat of the above-mentioned type, characterized in that of at least a number of modules in the conveyor mat, the end hinge plate and/or the plate-shaped part that is located opposite the end hinge plate extends to a position below the surface of the mat formed by the successive modules, the arrangement being such that the thus formed downward extension forms a lateral guide for the conveyor mat.

In accordance with a second aspect, the invention provides a conveyor mat of the above type, characterized in that for each module of the conveyor mat, the end hinge plate and the plate-shaped part that is located opposite the end hinge plate are provided with a recess extending throughout the length of the module and adjoining the bottom face of the mat formed by the successive modules, the arrangement being such that the recesses can cooperate with a guide of U-shaped cross section.

Surprisingly, it has been found that by the features according to the invention, a conveyor mat for use with shrink-wrap machines is readily obtained, which conveyor mat can be manufactured in an inexpensive manner, which has a substantially completely smooth and flat lateral edge and can be guided over a tubular member or a U-shaped section located between the downwardly directed guide faces formed on either side of the mat or engaging the recesses present on either side of the mat respectively, enabling adjacent mats to be built with their lateral edges closely against one another, if so desired.

Further advantages are that the mat can easily be lifted from the section due to the lack of so-called tabs or bevels for guidance. Also, the mat according to the invention can be extremely narrow, for instance 30 mm, which may be desired for specific practical applications, such as the transport of cans of beverage.

Preferably, also in the mat according to the first aspect of the invention, both the end hinge plate and the plate-shaped part of each module in the mat are designed with a downward extension. Further, adjacent each hinge plate there is preferably provided a plate-shaped part.

Hereinafter, the invention will be specified on the basis of two exemplary embodiments, with reference to the accompanying drawings. In these drawings:

FIGS. 1*a–d* are a bottom view, a side elevation and two end views respectively of a module intended for the conveyor mat according to the first embodiment of the invention;

FIG. 2 is a perspective view of a portion of a conveyor mat assembled from modules according to FIG. 1, on a guide rail;

FIGS. 3*a–d* are a perspective view, a top plan view, a side elevation and an end view respectively of a module intended for a conveyor mat according to a second embodiment of the invention; and FIG. 4 is a perspective view of a portion of a conveyor mat assembled from modules according to FIG. 3, on a guide section.

FIG. 1 shows an exemplary embodiment of a module for a conveyor mat according to the invention, which mat is of the so-called "raised rib" type. However, it is emphasized that the advantages of the conveyor mat according to the invention also continue to exist when the mat is of the so-called "flush grid" or "flat top" type, where the hinge plates of the modules of the mat are not provided with raised, plate-shaped parts for supporting products to be conveyed or are provided with an entirely closed top face.

A module 10 forms one whole and is, for instance, manufactured by injection molding. A module comprises an end hinge plate 11 and a number of substantially identical hinge plates 12, equally spaced apart, each hinge plate being provided, on both ends and on both sides of the body of the hinge plate, with thickened hinge loops 13', 13", in which an opening 16 for a hinge pin is formed. The end hinge plate 11 does not have this thickening of the hinge loops on the outside of the module. The hinge loops and openings are configured such that all openings of the modules register, also when the hinge plates of two modules adjoining in longitudinal direction of the mat interlock in that the hinge plates of one module are in each case located between the hinge plates of the other module. In this manner, the width of a module is determined by the number of hinge plates of which it consists and the length of a module is determined by the length of a hinge plate.

The hinge plates 12 are provided with plate-shaped parts 14 extending upwards in the plane of the respective hinge plates and constituting a bearing face for products to be conveyed.

Provided next to the hinge plates 12 of a module, always equally spaced therefrom, are plate-shaped parts 15, serving to create in a mat assembled from a series of modules a conveying face that is closed as regularly as possible and has a lightest possible construction, which is of importance for a low driving power required and for a low cost price. However, it is possible to provide a plate-shaped part 15 at the end of the module only, for instance in a flat-top mat.

The hinge plates 12 and the plate-shaped parts 15 are interconnected and are equally spaced apart by a transverse rib 18.

On the bottom side of the modules, additional ribs 19 may be provided, as shown in FIG. 1*b,* to support the plate-shaped parts 15 and reinforce the modules, these ribs lying between the ends of a module in one plane with the bearing face of the module.

As shown in FIG. 2, the conveyor mat according to the invention is built up from a single row of modules, of which modules the end hinge plates 11 are alternately located on one and the other lateral side of the mat.

According to the invention, in a module, at least the end hinge; plate 11 or a plate-shaped part 15, preferably the plate-shaped part at the end of the module, and preferably, both, is/are provided with a plate portion 11' or 15' respectively, extending to a position below the bottom face formed by the successive modules. These plate portions serve for guiding the mat over a rail 20, for instance a rectangular tube. For different mat widths, this tube may, for instance, have a width of 30, 40 or 50 mm, the total mat width being 38, 48 or 58 mm respectively. Such narrow mats have hitherto been impossible to realize.

As is clearly demonstrated in FIG. 2, the lateral side of the conveyor mat formed by the successive modules is entirely flat without laterally projecting parts. This does not only offer the possibility of forming one large conveying face with several mats juxtaposed in the width direction and driven at the same speed, without any irregularity in the pattern of the raised ribs which jointly constitute the bearing surface for products, but also of driving the juxtaposed mats at different speeds without causing the risk of the lateral sides catching behind each other or obstructing each other's progress.

FIGS. 3 and 4 show an exemplary embodiment of the conveyor mat according to the second aspect of the invention. In these Figures, identical parts are designated by the same reference numerals as in FIGS. 1 and 2, but preceded by the number "1".

The difference from the embodiment according to FIGS. 1 and 2 is that the end hinge plate 111 and the outer plate-shaped part 115 are provided with a recess 111" and 115" extending throughout the length of the module, from the bottom side of the module to about halfway the height of the hinge loops 116. As FIG. 4 shows, the mat assembled from such modules can simply be-guided through a U-shaped guide section 120. In this variant, too, several mats can be mounted in close side-by-side relationship, while for the guidance, for instance a single plate having raised parallel ribs can be used, each rib, except the outermost two ribs, having such width that it can act as rail for two adjoining mats.

What is claimed is:

1. A conveyor mat built up from modules (10) manufactured in one whole from plastic, each module consisting of a number of substantially equally spaced apart hinge plates (12) and an end hinge plate (11), each extending over substantially the entire length of the module and each having both ends provided with hinge loops (13', 13"), the hinge plates (12) of a module being intercoupled by at least one transverse rib (18) and there being provided, adjacent at least the outer hinge plate at the transverse end of the module located opposite the end hinge plate, a plate-shaped part (15) extending parallel to said hinge plate over a distance smaller than the distance between the hinge loops (13', 13") in a hinge plate (11, 12) and coupled to the at least one rib of the module and whose top side lies substantially in one plane with the top side of the mat, the end hinge plates of the successive modules being alternately located on one and on the other lateral side of the conveyor mat, the ends of the hinge plates on a longitudinal side of a module being located between the ends of the hinge plates of a module adjoining in longitudinal direction of the mat, the hinge loops of the two modules being substantially in alignment and intercoupled by a hinge pin extending through the hinge loops, characterized in that of at least a number of modules, the end hinge plate (11) and/or the plate-shaped part (15) that is located opposite the end hinge plate extends to a position below the bottom face of the mat formed by the successive modules, the arrangement being such that the thus formed downward extension forms a lateral guide for the conveyor mat.

2. A conveyor mat built up from modules (110) manufactured in one whole from plastic, each module consisting of a number of substantially equally spaced apart hinge plates (112) and an end hinge plate (111), each extending over substantially the entire length of the module and each having both ends provided with hinge loops (113', 113"), the hinge plates (112) of a module being intercoupled by at least one transverse rib (118) and there being provided, adjacent at least the outer hinge plate at the transverse end of the module located opposite the end hinge plate, a plate-shaped part (115) extending parallel to said hinge plate over a distance smaller than the distance between the hinge loops (113', 113") in a hinge plate (111, 112) and coupled to the at least one rib of the module and whose top side lies substantially in one plane with the top side of the mat, the end hinge plates of the successive modules being alternately located on one and on the other lateral side of the conveyor mat, the ends of the hinge plates on a longitudinal side of a module being located between the ends of the hinge plates of a module adjoining in longitudinal direction of the mat, the hinge loops of the two modules being substantially in alignment and intercoupled by a hinge pin extending through the hinge loops, characterized in that in each module in the conveyor mat, the end hinge plate (111) and the plate-shaped part (115) that is located opposite the end hinge plate are provided with a recess (111", 115") extending throughout the length of the module and adjoining the bottom face of the mat formed by the successive modules, the arrangement being such that the recesses (111", 115") can cooperate with a guide having a U-shaped cross section.

3. A conveyor mat according to claim 1, characterized in that next to each hinge plate (11, 12; 111, 112) there is provided a plate-shaped part (15; 115).

4. A conveyor mat according to claim 1, characterized in that each hinge plate comprises a further plate-shaped par (14; 114) extending upwards in the plane of said hinge plate over substantially the entire length thereof, the top sides of the further plate-shaped parts forming a conveying face and the top side of the plate-shaped parts (15; 115) being substantially located in one plane with the top sides of the further plate-shaped parts (14; 114).

5. A conveyor mat according to claim 1, characterized in that the top side of each module forms a closed surface.

6. A conveyor mat according to claim 1, characterized in that both the end hinge plate and the plate-shaped part extend to a position below said bottom face.

7. A module for a conveyor mat built up from modules (10) manufactured in one whole from plastic, each module consisting of a number of substantially equally spaced apart hinge plates (12) and an end hinge plate (11), each extending over substantially the entire length of the module and each having both ends provided with hinge loops (13', 13"), the hinge plates (12) of a module being intercoupled by at least one transverse rib (18) and there being provided, adjacent at least the outer hinge plate at the transverse end of the module located opposite the end hinge plate, a plate-shaped part (15) extending parallel to said hinge plate over a distance smaller than the distance between the hinge loops (13', 13") in a hinge plate (11, 12) and coupled to the at least one rib of the module and whose top side lies substantially in one plane with the top side of the mat, the end hinge plates of the successive modules being alternately located on one and on the other lateral side of the conveyor mat, the ends of the hinge plates on a longitudinal side of a module being located between the ends of the hinge plates of a module adjoining in longitudinal direction of the mat, the hinge loops of the two modules being substantially in alignment and intercoupled by a hinge pin extending through the hinge loops, characterized in that of the module, the end hinge plate (11) and/or the plate-shaped part (15) that is located opposite the end hinge plate extends to a position below the bottom face of the module formed by the successive hinge plates (12).

8. A module for a conveyor mat built up from modules (110) manufactured in one whole from plastic, each module consisting of a number of substantially equally spaced apart hinge plates (112) and an end hinge plate (111), each extending over substantially the entire length of the module and each having both ends provided with hinge Ioops (113', 113"), the hinge plates (112) of a module being intercoupled by at least one transverse rib (118) and there being provided, adjacent at least the outer hinge plate at the transverse end of the module located opposite the end hinge plate, a plate-shaped part (115) extending parallel to said hinge plate over a distance smaller than the distance between the hinge loops (113', 113") in a hinge plate (111, 112) and coupled to the at least one rib of the module and whose top side lies substantially in one plane with the top side of the mat, the end hinge plates of the successive modules being alternately located on one and on the other lateral side of the conveyor mat, the ends of the hinge plates on a longitudinal side of a module being located between the ends of the hinge plates of a module adjoining in longitudinal direction of the mat, the hinge loops of the two modules being substantially in alignment and intercoupled by a hinge pin extending through the hinge loops, characterized in that of the module, the end hinge plate (111) and the plate-shaped part (115) that is located opposite the end hinge plate are provided with a recess (111", 115") extending throughout the length of the module and adjoining the bottom face of the module.

* * * * *

UNITED STATES PATENT AND TRADEMARK OFFICE

CERTIFICATE OF CORRECTION

PATENT NO. : 6,453,047 B1
DATED : September 17, 2002
INVENTOR(S) : Dicker et al.

It is certified that error appears in the above-identified patent and that said Letters Patent is hereby corrected as shown below:

Delete Specifications and Claims, to be replaced with Specification and Claims as shown on the attached sheets.

Signed and Sealed this

Eighteenth Day of January, 2005

JON W. DUDAS
*Director of the United States Patent and Trademark Office*

MATRIX ENCODING SYSTEM WITH IMPROVED BEHAVIOR FREQUENCY

CROSS-REFERENCES TO RELATED APPLICATIONS

This application claims priority from provisional application Serial No. 60/102,192, filed Sep. 28, 1998, entitled "Three Channel Panning System," the disclosure of which is incorporated herein by reference.

BACKGROUND OF THE INVENTION

Arrays of loudspeakers are utilized to simulate the playback of audio in 3 dimensions. One such system, manufactured by Dolby® systems, utilizes four speakers designated Left, Right, Center, and Surround. Different audio signals are fed to each loudspeaker and the sounds emitted by the loudspeakers are intended to simulate a 3-dimensional audio experience to a listener with the Left and Right speakers in front positioned to his/her left and right, the Center speaker directly in front, and the Surround speaker behind.

Since many systems only utilize two channels and provide only two loudspeaker signals, often the four channels, Left, Right, Center, and Surround, are encoded into left and right stereo signals.

FIG. 1 depicts a system for implementing "Dolby® Stereo" MP Matrix encoding. Referring to FIG. 1, the Center signal is attenuated −3 dB and mixed equally with the left and right stereo channels.

The surround channel is attenuated −3 dB, fed through a band-pass filter (bpf), and phase-shifted before mixing with the left and right channels. This bpf filters out low-frequency and high-frequency sounds. The (Lt,Rt) stereo output is intended to be played through a Dolby ProLogic decoder. The encoding formulas are:

$$Lt=L+0.7*C+0.7*j*nr*bpf*S;$$

$$Rt=R+0.7*C-0.7*j*nr*bpf*S;$$

Where:

j=90 degree phase-shift nr=Dolby® 'Nr' encoder bpf=band-pass filter

The band-pass filter has −12 dB/oct above a cut frequency of 7 kHz, and also cuts off frequencies below 100 Hz.

Typically, the surround channel is used to drive a array of loudspeakers placed behind and on the sides of the listener. For movies and concerts most of the important sounds emanate from sources in front of the listener so that the reduced frequency range for the encoded surround channel does not result in serious degradation of the surround channel.

However, for multimedia applications, such as video games, the listener is immersed in a 3-dimensional sound field where important sound sources may be behind the listener. In particular, explosions, or other sounds having a significant low-frequency component, might occur behind the listener.

Accordingly, for multimedia an two-channel encoding system that does not filter low-frequency sounds needs to be utilized.

SUMMARY OF THE INVENTION

According to one aspect of the invention, an encoder utilizes all-pass filters to create phase shifts between the left, right, and surround channel signals prior to summing the phase-shifted signals. A pair of first all-pass filters, one in each of a left and right encoding path, introduce a first frequency-dependent phase shift into the left and right signals. A second all-pass filter introduces a second frequency dependent phase-shift into the surround signal. The first and second frequency shifts are near zero below a cutoff frequency and the relative phase shift between the outputs of the first and second all-pass filters is about 90° above the cutoff frequency.

According to another aspect of the invention, the output of the second all-pass filter is phase-shifted by about 180° before being summed with the left encoding path and the output of the second all-pass filter is summed without phase-shifting to the right encoding path.

According to another aspect of the invention, a third-all pass filter introduces a third frequency-dependent phase shift into the surround channel signal. The third frequency-dependent phase shift is near zero below a cutoff frequency and the relative phase shift between the outputs of the third and second all-pass filters is about 180° above the cutoff frequency. The third all-pass filter couples the surround channel signal a summing node with the left signal. Accordingly, the surround channel signals coupled to the left and right encoding path are 180° out of phase above the cutoff frequency.

According to another aspect of the invention, all signals are digitized and all filters are implemented as digital filters.

Additional features and advantages of the invention will be apparent in view of the following detailed description and appended drawings.

DESCRIPTION OF THE SPECIFIC EMBODIMENTS

Figure 1:
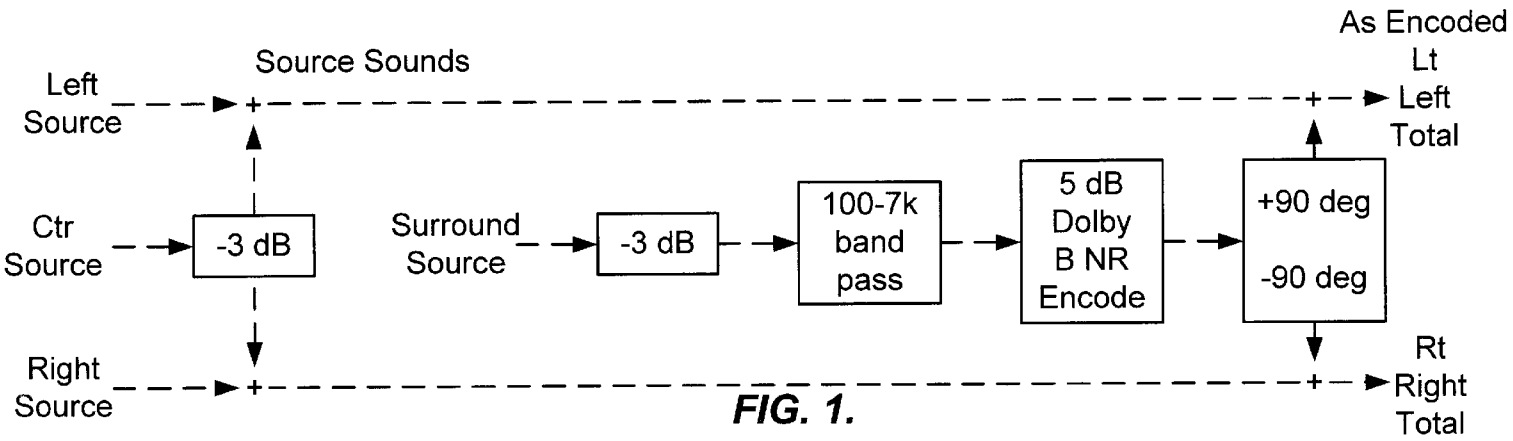
FIG. 1 is a schematic diagram of a prior art encoder.
Figure 2:
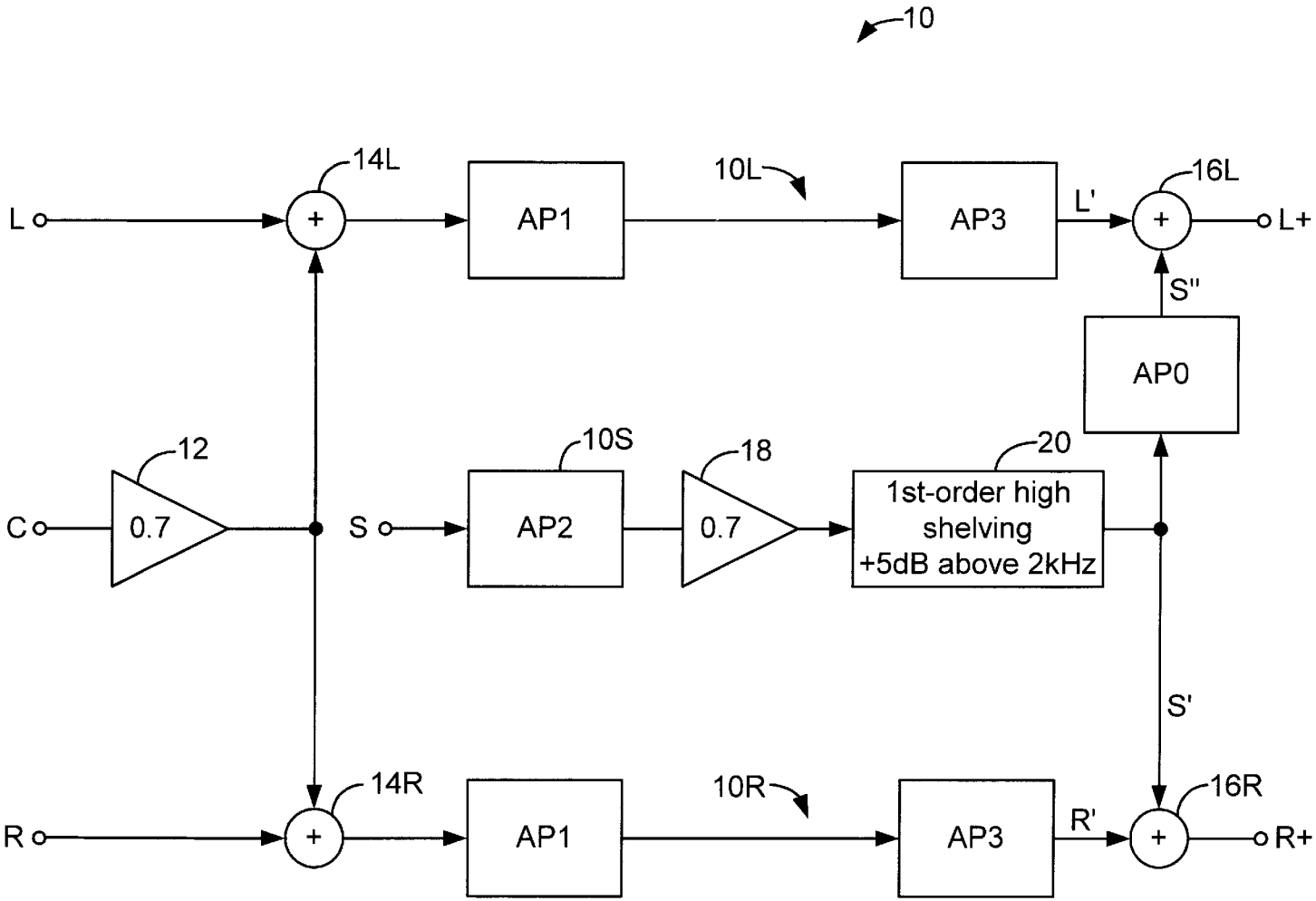
FIG. 2 is a schematic diagram of an embodiment of a decoder.

FIG. 2 is a block diagram of a preferred embodiment of the invention. In FIG. 1, the inputs to the encoder 10 are the quad inputs Left, Right, (optionally) Center, and Surround (L,R,C,S) and the outputs are the stereo outputs Lt and Rt. The C signal is input to a first −3 dB attenuator 12. A first left path summing node 14L receives the L signal and the output of the first attenuator 12. A first right path summing node 14R receives the R signal and the output of the first attenuator 12. Both the left and right encoding paths 10L and 10R include a first all-pass filter (AP1), a third all-pass filter (AP3), and second summing nodes 16L and 16R.

A surround signal path 10S includes a second all-pass filter (AP2), a second −3 dB attenuator 18, and first order high shelving filter 20. The output of the first order high shelving filter 20 is coupled to the second left summing node 16L through a $0^{th}$ all-pass filter (AP0) and coupled directly to the second right summing node 16R. The output of the second left summing node 16L is the Lt encoded stereo signal and the output of the second right summing node 16R is the Rt encoded stereo signal.

Figure 3:
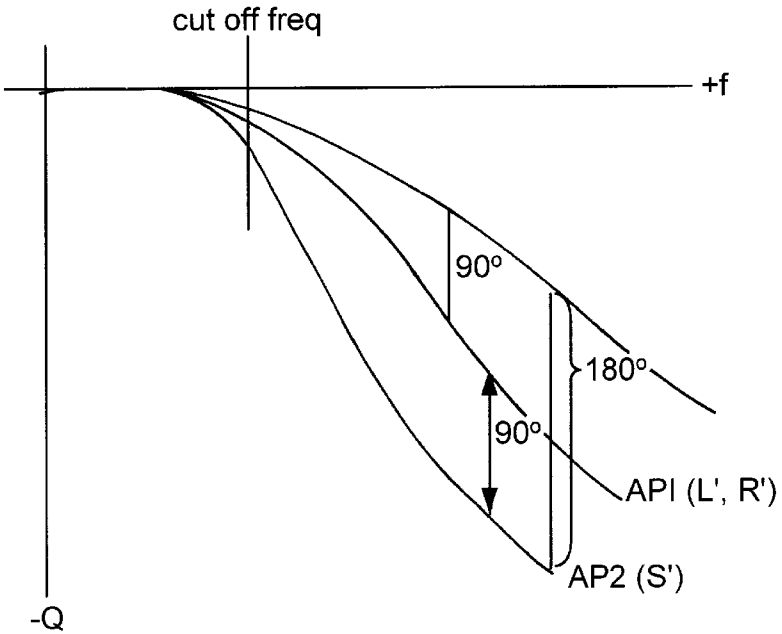
FIG. 3 is a graph depicting the frequency-dependent phase shifts of APO, AP1, and AP2.

The first and second all-pass filters AP1 and AP2 transmit all frequencies without attenuation. However, the filters introduce a frequency-dependent phase shift into the output signals. The dependence of phase on frequency for both AP1 and AP2 is depicted in FIG. 3. Note that for low frequencies, below a cutoff frequency ($f_0$) there is almost no phase difference between the output of AP1 (L', R') and the output of AP2 (S'). However, as the frequency increases above $f_0$ the phase of S" lags the phase of (L',R') by about −90°. In a preferred embodiment $f_0$ is about 100 Hz.

It is desired to advance the phase of the left component of the encoded surround signal (S") by +90°. A straightforward way of advancing the phase would be to multiply S' by −1. However, doing so would cause a phase shift between the left and right components of S' at all frequencies so that frequencies below the cutoff frequency would be encoded into the surround channel.

In the preferred embodiment the phase of the left component of S' is advanced by AP0, which is an all-pass filter having a frequency dependent phase shift as depicted in FIG. 3 AP0 is a first-order all-pass filter whose phase response varies from 0° at low frequencies below $f_0$ to 180° above at frequencies above $f_0$. This avoids encoding low frequencies to the surround channel. This is necessary because standard Dolby® decoders apply a high-pass filter to the surround channel, so low frequencies would be lost when a sound is panned to the rear.

Referring again to FIG. 3, at low frequencies below $f_0$ the phase shift is very small between APO, AP1, and AP2. However, at large frequencies above $f_0$ the phase shift of the output of AP0 (S") is advanced by 180° relative to the phase shift of the output of AP2 (S'). Thus, the phase of S' is retarded by −90° relative to R' and the phased of S" is advanced by+90° relative to L'.

The use of AP2 and AP0 to implement the ±90° phase shifts between S' and S" allows the surround channel to be encoded without using a band-pass filter as in the prior art. As described above, this bpf cuts off frequencies below a 100 Hz and therefore would distort or eliminate sounds included in the surround channel, such as explosions, having a large low-frequency component.

The shelving filter 20 boosts the signal above 2 kHz by +5 dB to be compatible with standard decoders. This shelving filter introduces a phase shift which is canceled by all-pass filters AP3 in the left and right signal paths.

The left and right stereo channels are represented algebraically by:

$$L=AP1*(L+0.7*C)+AP2(0.7*nr*lpf*S);$$

$$R=AP1*(L+0.7*C)+AP0*AP2*(0.7*nr*lpf*S)$$

where nr*lpf represents the effect of the shelving filter.

In practice, it has been found that good results can be achieved if the center input channel is not used. Further, for systems with multiple rear sound channels, the rear sound channels can be summed and input to the surround (S) input of the encoder 10 of FIG. 2.

In a preferred embodiment, filters AP0, AP1, AP2, AP3, and the shelving-filter 20 are digital filters implemented in software. The quad channel signals are digitized using methods well-known in the art and the digital values are processed by a data processor executing code to implement the transfer functions of the various filters.

The all-pass filters AP1 and AP2 are implemented by cascading two all-pass biquadradic filters.

For AP1, the denominators of the two biquadradic filters are:

$$1-1.94632*(z^{-1})+0.94657*(z^{-2})$$

$$1-0.83774*(z^{-1})+0.06338*(z^{-2})$$

For AP2 (90 degree shift), the denominators are:

$$1+0.02569*(z^{-1})-0.260502*(z^{-2})$$

$$1-1.86850*(z^{-1})+0.870686*(z^{-2})$$

The phase response of AP2 relative to AP1 is 90 degrees +/− 1 degree from about 400 Hz to about 15000 Hz. the above coefficients apply for a sampling rate of 48,000 Hz.

As is well-known, the various components depicted in FIG. 3 can also be implemented to process the analog quad signals. Analog filters and components to implement the above-described digital filters can be designed based on the above-provide parameters.

The invention has now been described with reference to the preferred embodiments. Alternatives and substitutions will now be apparent to persons of skill in the art. For example, the filters AP1 and AP2 can be modified to move the limit frequencies below which no phase shift occurs to the surround channel. Accordingly, it is not intended to limit the invention except as provided by the appended claims.

What is claimed is:

1. A method for encoding first and second front channel signals and a rear channel signal into stereo first and second channel signals, said method comprising the steps of:

all-pass filtering said first and second front channel signals to introduce the same first frequency dependent phase shift in each of said first and second front channel signals to produce first and second filtered front channel signals, with said first frequency dependent phase shift being substantially zero below a first cutoff frequency;

all-pass filtering said rear channel signal to introduce a second frequency dependent phase shift in said rear channel signal to produce a filtered rear channel signal, with said second frequency dependent phase shift being substantially zero below the first cutoff frequency and with the phase of the filtered rear channel signal being shifted by about 90° relative to the phase of the first and second filtered front channel signals;

phase-shifting said filtered rear channel signal to produce a phase-shifted filtered rear channel signal having a phase shift being about 180° relative to the phase of the filtered rear channel signal;

combining said first filtered front channel signal and said filtered rear channel signal to produce a first stereo channel signal; and combining said second filtered front channel signal and said phase-shifted filtered rear channel signal to produce said second stereo channel signal.

2. The method of claim 1 where said step of phase-shifting comprises the step of:

all-pass filtering said filtered rear channel signal to introduce a third frequency dependent phase shift in said filtered rear channel signal to produce a phase-shifted filtered rear channel signal, with said third frequency dependent phase shift being substantially zero below the first cutoff frequency and with the phase of the phase-shifted filtered rear channel signal being shifted by about 180° relative to the phase of the filtered rear channel signal above the first cutoff frequency.

3. The method of claim 1 further comprising the step of:

shelf-filtering said rear channel signal to boost the amplitude of frequency components above about 2 kHz.

4. The method of claim 3 further comprising:

all-pass filtering said first and second filtered front channel signals to introduce a frequency-dependent phase canceling a phase shift caused by said shelf-filtering step.

5. The method of claim 1 further comprising:

mixing a center front channel signal equally between said first and second stereo channel signals.

6. A computer program product, said computer program product comprising:

a computer readable storage structure embodying computer readable program code therein, said computer readable program code for encoding first and second front channel signals and a rear channel signal into first and second stereo signals when executed by a computer, said computer readable program code comprising:

computer readable program code for all-pass filtering said first and second front channel signals to introduce the same first frequency dependent phase shift in each of said first and second front channel signals to produce first and second filtered front channel signals, with said first frequency dependent phase shift being substantially zero below a first cutoff frequency when executed;

computer readable program code for all-pass filtering said rear channel signal to introduce a second frequency dependent phase shift in said rear channel signal to produce a filtered rear channel, with said second frequency dependent phase shift being substantially zero below the first cutoff frequency and with the phase of the filtered rear channel signal being shifted above the cutoff frequency by about 90° relative to the phase of the first and second filtered front channel signals when executed;

computer readable program code for all-pass filtering said filtered rear channel signal to introduce a third frequency dependent phase shift in said filtered rear channel signal to produce a phase-shifted filtered rear channel signal, with said third frequency dependent phase shift being substantially zero below the first cutoff frequency and with the phase of the phase-shifted filtered rear channel signal being shifted by about 180° relative to the phase of the filtered rear channel signal above the first cutoff frequency;

computer readable program code for combining said first filtered front channel signals and said filtered rear channel signal to produce a first stereo channel signal when executed; and computer readable program code for combining said second filtered front channel signal and said phase-shifted filtered rear channel signal to produce said second stereo channel signal when executed.

7. A system for encoding first and second front channel signal and a rear channel signal into stereo first and second channel signals, said system comprising:

a pair of first all-pass filters for filtering said first and second front channel signals to introduce the same first frequency dependent phase shift in each of said first and second front channel signals to produce filtered first and second filtered front channel-signals, with said first frequency dependent phase shift being substantially zero below a first cutoff frequency;

a second all-pass filter for filtering said rear channel signal to introduce a second frequency dependent phase shift in said rear channel signal to produce a filtered rear channel, with said second frequency dependent phase shift being substantially zero below the first cutoff frequency and with the phase of the filtered rear channel signal being shifted by about 90° relative to the phase of the first and second filtered front channel signals;

a phase shifter for phase-shifting said filtered rear channel signal to produce a phase-shifted filtered rear channel signal having a third phase shift being about 180° relative to the phase of the filtered rear channel signal;

a first summing element for combining said first filtered front channel signals and said filtered rear channel signal to produce a first stereo channel signal; and a second summing element for combining said second filtered front channel signal and said phase-shifted rear channel signal to produce said second stereo channel signal.

8. The system of claim 7 where said phase-shifter comprises:

a third all-pass filter for filtering said filtered rear channel signal to introduce a third frequency dependent phase shift in said filtered rear channel signal to produce a phase-shifted filtered rear channel, with said third frequency dependent phase shift being substantially zero below the first cutoff frequency and with the phase of the phase-shifted filtered rear channel signal being shifted by about 180° relative to the phase of the filtered rear channel signal above the first cutoff frequency.

* * * * *

UNITED STATES PATENT AND TRADEMARK OFFICE

CERTIFICATE OF CORRECTION

PATENT NO. : 6,453,047 B1
DATED : September 17, 2002
INVENTOR(S) : Dicker et al.

It is certified that error appears in the above-identified patent and that said Letters Patent is hereby corrected as shown below:

Title page, [54] and Column 1, lines 1-2,
Title, delete "MATRIX ENCODING SYSTEM WITH IMPROVED BEHAVIOR FREQUENCY" and insert -- MATRIX ENCODING SYSTEM WITH IMPROVED FREQUENCY BEHAVIOR --, therefore.

Title page,
Item [57], ABSTRACT,
Lines 1-13, delete "A conveyor mat built up from hingedly intercoupled plastic modules, each module consisting of a number of substantially equally spaced apart hinge plates extending throughout the length of the module and provided with hinge loops at both ends thereof, the outer hinge plate and a plate-shaped part located on the outer side of a module of at least a number of modules extending to a position below the bottom face of the mat formed by the successive modules or being provided with a recess in the longitudinal direction of the module, the arrangement being such that the thus formed downward extension and/or the recesses form a lateral guide for the conveyor mat and can cooperate with a tubular or U-shaped guide section respectively." and insert -- An encoder for encoding multiple sound channels into two channels that utilizes all-pass filters to cause frequency dependent phase shifts between the sound channels. A first all-pass filter in each of the left and right paths causes a 90° phase between left and right sound channels fed through the first filter in each channel and a surround channel fed through a second all-pass filter at frequencies above a cutoff frequency. The phase shift below the cutoff frequency is near zero. A third all-pass filter introduces a 180° phase shift into the output of the second all-pass filter above the cutoff frequency. The output of the third all-pass filter is mixed with the left channel and the output of the second all-pass filter is mixed with the right channel so that the mixed surround signals are 180° out of phase. --, therefor.

Signed and Sealed this

Twenty-second Day of November, 2005

JON W. DUDAS
*Director of the United States Patent and Trademark Office*